United States Patent [19]

Quayle

[11] 4,032,244

[45] June 28, 1977

[54] POLE TOP EXTENSION BRACKET

[76] Inventor: Jackson C. Quayle, 10225 Darrow Road, Twinsburg, Ohio 44087

[22] Filed: Apr. 26, 1976

[21] Appl. No.: 680,290

[52] U.S. Cl. ..... 403/286; 403/293; 403/306; 61/53

[51] Int. Cl.[2] ..... B25G 3/00

[58] Field of Search ..... 403/301, 306, 309, 312, 403/286, 293; 52/514, 726, 758 F, 758 C, 753 L; 61/53

[56] References Cited

UNITED STATES PATENTS

| | | | |
|---|---|---|---|
| 1,073,614 | 9/1913 | McDearmid | 61/53 |
| 1,416,641 | 5/1922 | Jaeckle et al. | 52/514 X |
| 1,420,430 | 6/1922 | Jaeckle et al. | 403/312 |
| 2,222,481 | 11/1940 | Ferguson et al. | 61/53 X |
| 2,828,515 | 4/1958 | Jenne | 52/753 L X |
| 3,201,834 | 8/1965 | Baittinger | 61/53 X |

FOREIGN PATENTS OR APPLICATIONS

| | | | |
|---|---|---|---|
| 2,116,538 | 2/1973 | Germany | 52/726 |

*Primary Examiner*—Wayne L. Shedd
*Attorney, Agent, or Firm*—Meyer, Tilberry & Body

[57] ABSTRACT

An extension for a wooden utility pole is provided in which a novel bracket is secured to the flattened top of an existing pole. A projecting center shaft extends from the bracket to be received within matching center bores provided in the utility pole, a wooden extension pole or both. Threaded fasteners and metal straps complete the interconnection between the existing pole and the extension pole.

15 Claims, 8 Drawing Figures

FIG. 2
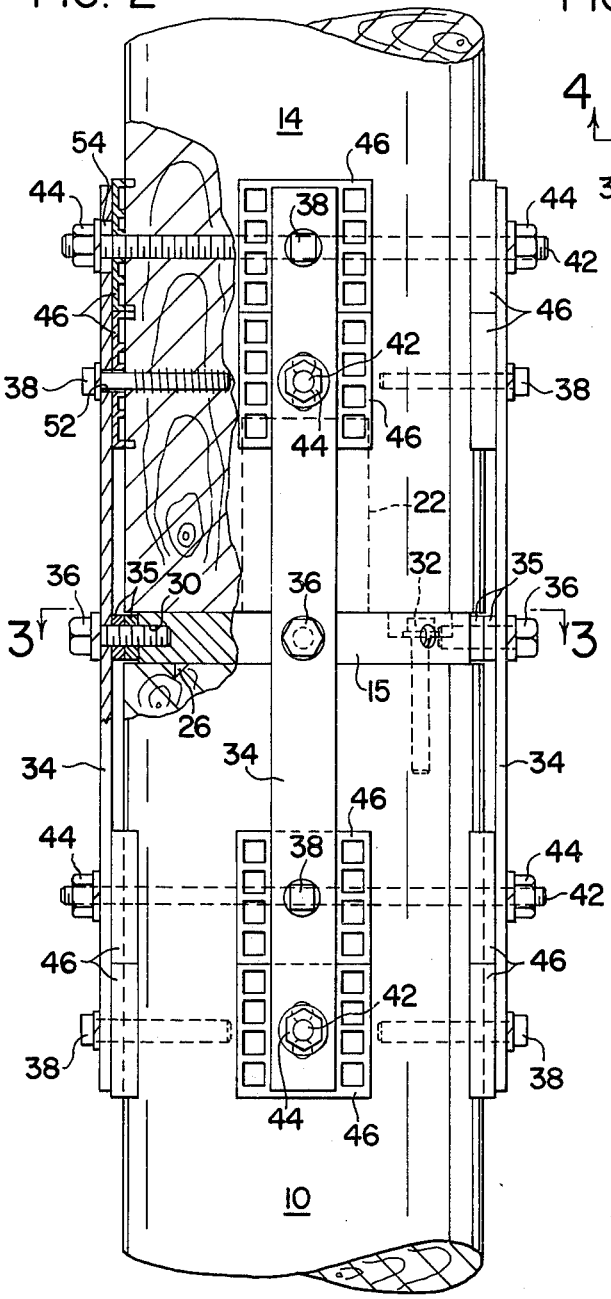
FIG. 3
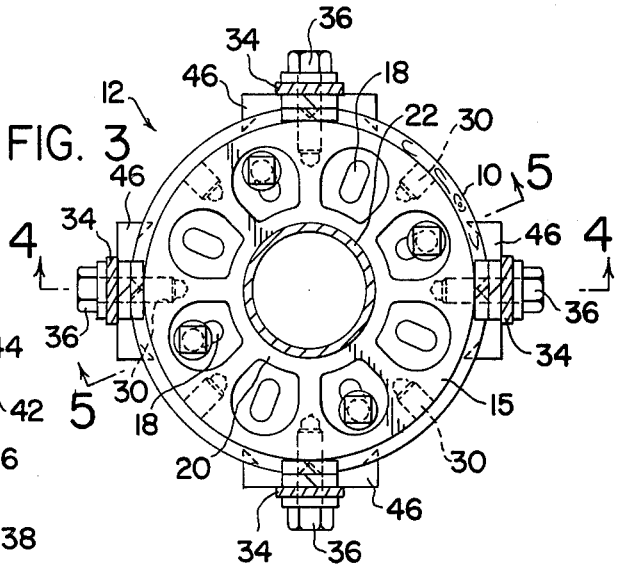
FIG. 4
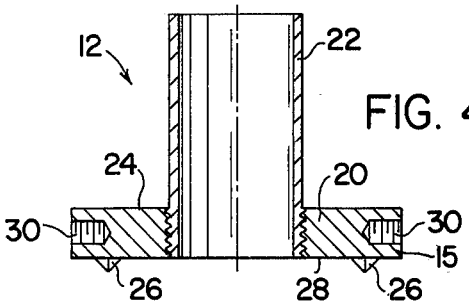
FIG. 5
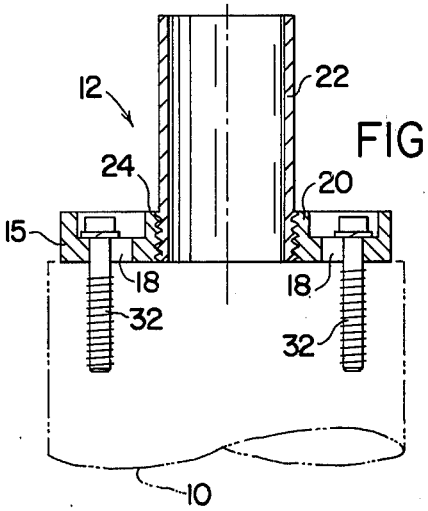
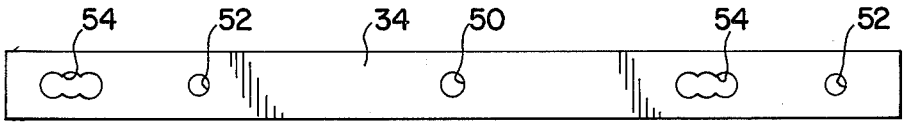
FIG. 6

POLE TOP EXTENSION BRACKET

This invention relates to a bracket for extending the height of wooden utility poles in lieu of replacing old shorter poles with new longer poles when conductor or cable requirements change, or for any other reason.

It is an object therefore of this invention to provide a means for extending the height of existing utility poles which is inexpensive, simple in concept, and easy to apply to existing poles. Other objects of this invention will become apparent from a reading of the disclosure taken into conjunction with the Figures and claims.

In the Figures:

FIG. 2 is a fragmentary view in elevation of a preferred embodiment of the invention as applied to a utility pole;

FIG. 3 is a plan view of the invention taken along the line 3—3 of FIG. 2;

FIG. 4 is a fragmentary sectional elevational view of the invention taken along the line 4—4 of FIG. 3;

FIG. 5 is a fragmentary sectional elevational view of the invention taken along the line 5—5 of FIG. 3;

FIG. 6 is a plan view of a strap used in conjunction with the invention;

Figure 1:
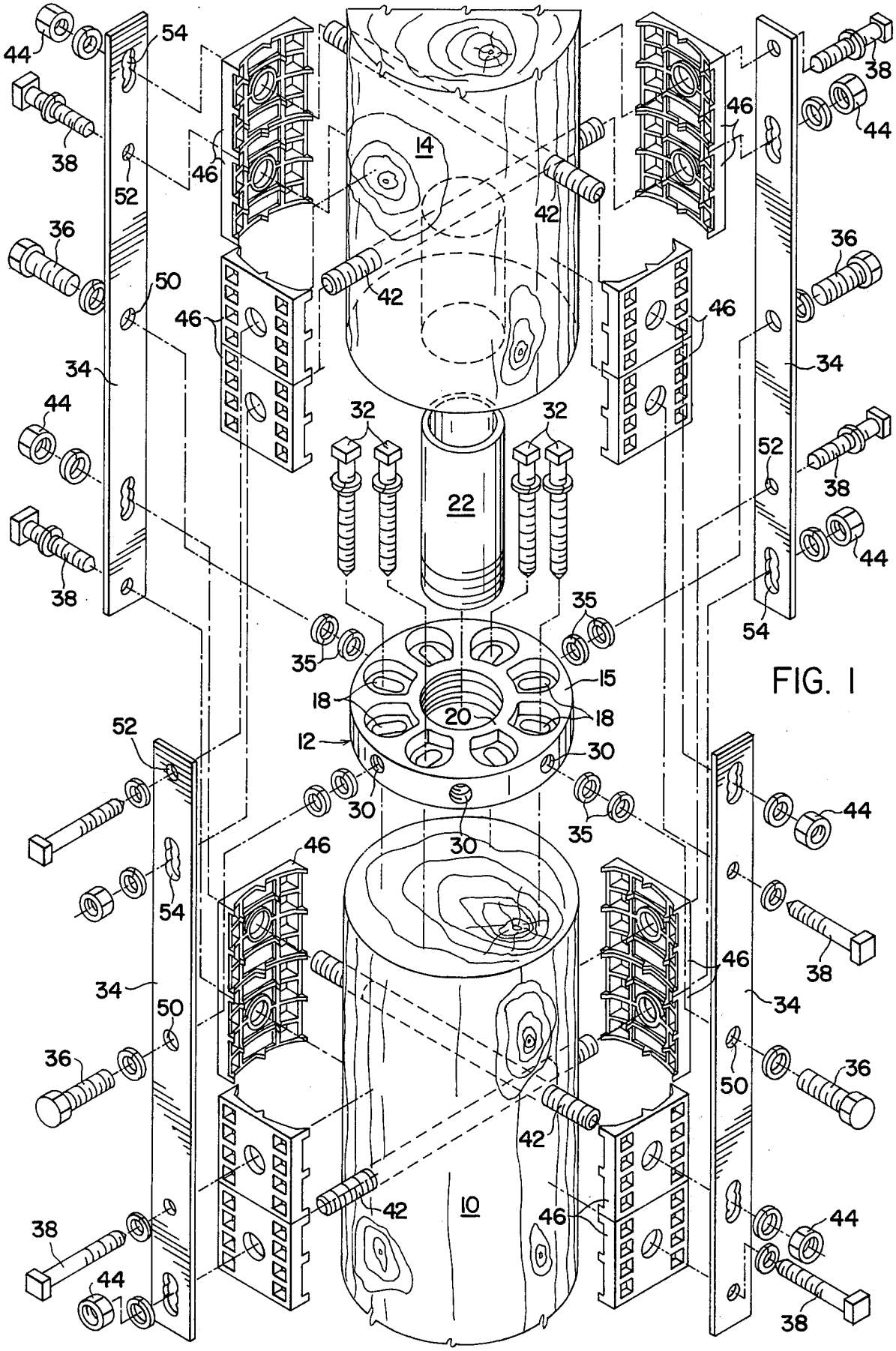
FIG. 1 is an exploded isometric view of a preferred embodiment of the invention illustrating the assembly thereof.

Referring now to the Figures in greater detail, and in particular to FIGS. 1 and 2, an existing utility pole 10 has secured to its top surface a pole top extension bracket 12 to which is also secured pole top extension member 14.

Referring to FIGS. 1 and 3, it will be seen that the pole top extension bracket 12 comprises a circular plate 15 which is provided with a plurality of substantially radially aligned reinforcing ribs 16. Between each pair of ribs is a radially elongated aperture 18. While a circular plate is preferred, it will be understood that the plate may be of any shape which substantially conforms to the cross-sectional shape of the pole top. At the center of the plate 15 the ribs 16 join to form a hub 20. Extending outwardly from hub 20 is a shaft 22, better shown in FIGS. 4 and 5, extending normally from the top face 24 of the plate 15. As shown in the Figures, the shaft 22 is preferably hollow to allow for storage of wood preservative materials which protect the pole from decay where decay conditions exist. It will be understood, however, that the shaft 22 may also be of a solid construction. FIGS. 1, 4, and 5 also show hub 20 and shaft 22 as being threaded for securing the shaft 22 to plate 15. As shown, this means of attachment of the shaft 22 to the plate 15 is only a preferred embodiment and other means for incorporating shaft 22 into the bracket 12 are contemplated within the scope of the invention such as by welding shaft 22 in place or casting the entire bracket including plate 15 and shaft 22 in one piece.

Also best shown in FIG. 4 are the teeth members 26 which may be provided on either the upper face 24, or lower face 28 or both of plate 15 to provide a good gripping contact between the upper flat surface of the existing pole and the lower flat surface of the pole top extension. Also as best shown in FIG. 4, are the holes 30 tapped to receive threaded strap fasteners such as machine bolts therein, as will be described more fully hereinbelow.

Referring to FIG. 5, it will be seen that the elongated radial holes 18 are adapted to receive lag screws 32 therethrough into the top face of the existing pole 10. The pole top extension 14 is center bored to receive shaft 22 therein to anchor pole top extension 14 to plate 15.

After the pole top extension 14 has been secured to plate 15 and positioned concentric with existing pole 10 on the top face of pole 10, pole straps 34 are bolted to the periphery of plate 15 with threaded strap fasteners such as machine bolts 36 passing through apertures 50 in straps 34. Although apertures 50 are shown in the FIGURES to be circular in form, they may alternatively be in the form of slots extending transversely of the longitudinal axis of straps 34 so as to accommodate possible horizontal deviations in the mounting of the straps 34 on the pole members. The upper and lower portions of straps 34 are provided with a special alternating arrangement of serrated slots 54 which in combination with holes 52, as shown in FIGS. 1 and 6, receive transverse bolts 42, or lag screws 38, respectively, as shown in FIGS. 1 and 2, thereby anchoring pole top extension 14 securely to existing pole 10. The serrated slots 54 and holes 52 in straps 34 are alternated so that identical straps may be used in a plane 90° from the plane of another set of straps and bolts when used in inverted position and there will be no interference from crossing transverse bolts 42, their position being in an above and below relationship. The elongated serrated slots 54 in straps 34 are to allow for deviation of the bolts through the pole from a horizontal plane. Transverse bolts 42 are secured with nuts 44 following insertion through the pole and straps. It will be understood that in place of transverse bolts 42, additional lag bolts such as bolts 38 may be utilized to effect the attachment of straps 34 to the existing pole 10 and the pole top extension 14.

In order to accommodate existing poles of greater diameter than plate 15, washers 35 may be placed over machine bolts 36 between plate 15 and pole straps 34 until the pole straps make planar contact through washers 35 along the periphery of the plate 15 and the longitudinal surface of the existing pole 10 and the pole top extension 14 as shown best in FIG. 1. Also, to accommodate existing poles with a diameter less than that of the plate 15 washers 35 may be placed on lag screws 38 and the transverse bolts 42 at a point between straps 34 and the timber connectors 46.

The plate 15 may be cast from ferrous or non-ferrous metal depending on the strength requirements of the particular pole top extension installation. The straps 34 may be ferrous or non-ferrous metal depending also on strength requirements.

It should be understood that while the embodiment above-described teaches the attachment of plate 15 to existing pole 10 with shaft 22 passing into pole top extension 14, a reverse arrangement of the plate 15 attached to pole top extension 14 with shaft 22 extending into a center bore in existing pole 10 is also possible and included within the scope of the present invention.

Figure 7:
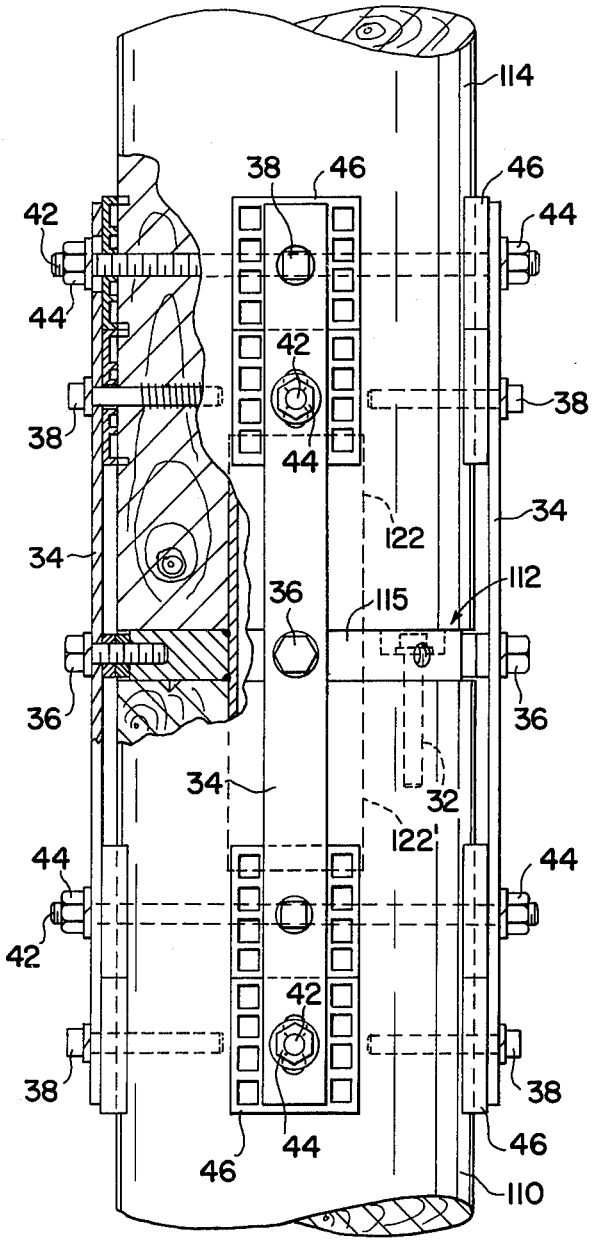
FIG. 7 is a fragmentary view in elevation of another embodiment of the present invention.

FIG. 7 illustrates an alternate embodiment of the invention in which both existing pole 110 and extension member 114 are centerboard to receive coaxial shafts 122′ and 122 respectively. It will be understood that shafts 122 and 122′ may be made in one piece extending through the plate 115 or may be two separate pieces. The central shaft may be attached by the various means previously described such as by welding or by casting or, in the case of a single piece shaft, the shaft may be merely slip-fit through the plate member. Except for the addition of downwardly extending shaft 122', the remaining structure of the bracket is similar to that shown in FIG. 1.

Figure 8:
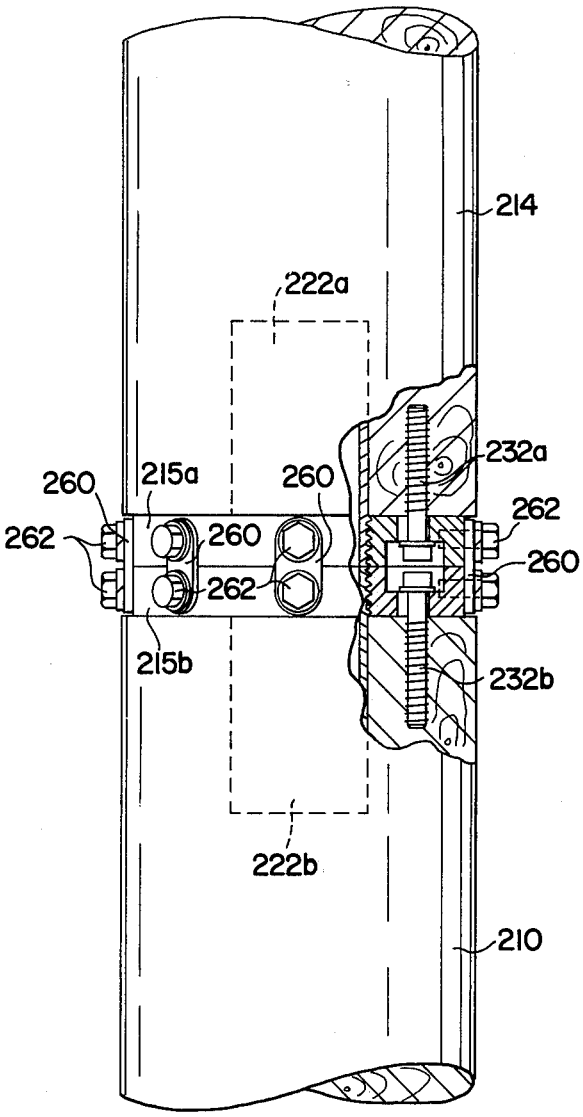
FIG. 8 is a fragmentary view in elevation of yet another embodiment in accordance with the invention.

FIG. 8 illustrates a further embodiment of the invention in which two plate members 215*a* and 215*b* are provided which are attached respectively to the pole top extension 214 and the existing pole 210 by means of lag bolts 232*a* and 232*b* respectively in a manner such as previously described. Plate member 215*a* is provided with coaxial upwardly extending shaft 222*a* which is received in a center bore provided in the pole top extension. Plate member 215*b* is provided with coaxial downwardly extending shaft 222*b* which is received in a center bore provided in existing pole 210.

In order to secure plate 215*a* to plate 215*b*, plate strap members 260 are provided which attach to plates 215*a* and 215*b* by threaded plate strap fasteners 262 passing therethrough.

Whereas certain preferred embodiments of my invention have been described herein, it is understood that other modifications within the scope of my invention will occur to those skilled in the art upon reading the foregoing disclosure. It is intended therefore that this invention only be limited by the scope of the claims set forth hereinbelow.

Having thus described my invention, I now claim:

1. A bracket for connecting a top extension pole member to an existing pole member each having an end portion comprising: a metal plate having parallel planar surfaces and a rigidly attached centrally located shaft member extending perpendicularly outwardly therefrom to be received in at least one corresponding center bore provided in one of said pole members; apertures provided through said plate and fastening means passing through said apertures for attaching said plate to the end portion of one of said pole members; strap members positioned vertically along the outer surfaces of said pole members and said plate and fastening means for securing said straps to said pole members and said plate to form a unified pole structure.

2. The device as described in claim 1, wherein said shaft member is hollow.

3. The device as described in claim 1, wherein said fastening means for attaching said plate to said pole member are lag screws.

4. The device as described in claim 1, wherein said fastening means for securing said straps to said plate are machine bolts.

5. The device as described in claim 1, wherein said fastening means for securing said straps to said pole members are lag screws.

6. The device as described in claim 1, wherein said straps have a plurality of alternating circular and longitudinally extending serrated apertures spaced longitudinally therealong and an elongated center aperture extending transversely of the longitudinal axes of said straps for mounting said straps to said plate.

7. The device as described in claim 4 including washers on said machine bolts between the periphery of said plate and said straps whereby said bracket may be made adjustable to pole members larger than said plate.

8. The device as described in claim 6, wherein sadi fastening means for securing said straps to said pole members comprises a plurality of transverse bolts passing through said serrated apertures in said straps transversely through said pole members and a plurality of lag screws passing through said circular apertures in said straps into said pole members.

9. The device as described in claim 1, wherein said shaft and said plate are matingly threaded and are attached to each other by engaging said threads.

10. A bracket for connecting a top extension pole member to an existing pole member each having an end portion comprising: a metal plate having parallel planar surfaces and a centrally located shaft member extending perpendicularly outwardly therefrom to be received in at least one corresponding center bore provided in at least one of said pole members; a plurality of reinforcing ribs extending radially outwardly from a central hub of said plate, a plurality of apertures passing through said plate located between said ribs, and fastening means passing through said apertures for attaching said plate to the end portion of one of said pole members; strap members positioned vertically along the outer surfaces of said pole members and said plate and fastening means for securing said straps to said pole members and said plate to form a unified pole structure.

11. The device as described in claim 10, wherein said apertures are radially elongated.

12. A bracket for connecting a top extension pole member to an existing pole member comprising a metal plate having a top and a bottom surface, said plate having a plurality of reinforcing ribs extending radially outwardly from a central hub; a center shaft extending perpendicularly outwardly from said hub of said plate; apertures between said ribs for receiving threaded fasteners therethrough for fastening said plate to an abutting end of one of said pole members, said center shaft fitting within a centerbore provided in one of said pole members when said bracket is mounted; said reinforcing ribs being radially machined to receive threaded strap fasteners therein in radial alignment within said ribs; and a plurality of metal straps each provided with a strap fastener aperture to secure said straps to the periphery of said plate and a plurality of strap securing apertures spaced longitudinally therealong to receive strap securing means for attaching said straps longitudinally to said existing and said extension poles.

13. A utility pole extension bracket for attaching a top extension pole to an existing utility pole comprising; a metal plate having a top and a bottom surface and having teeth projecting from said bottom surface; said plate having a plurality of reinforcing ribs extending radially outwardly from a central threaded hub and having radially elongated apertures between said ribs for receiving threaded fasteners therethrough for fastening said bracket to the top surface of said existing pole; a hollow center shaft having thread means receivable within said threaded hub and extending outwardly from the top surface of said plate at said hub to be received within a center bore of said top extension pole; said reinforcing ribs being radially machined to receive threaded strap fasteners therein in radial alignment within said ribs; a plurality of metal straps each provided with a strap fastener aperture for receiving said strap fasteners to secure said straps to said plate, and a plurality of strap securing apertures to receive strap securing means to attach said straps longitudinally to said existing and extension poles, said plurality of strap securing apertures including a plurality of circular holes and a plurality of longitudinally extended serrated holes, said holes alternating longitudinally along said strap, said plurality of strap securing means including a plurality of lag bolts receivable through said circular holes of said straps and a plurality of transverse bolts receivable through said serrated holes.

14. A bracket for connecting a pole top extension to an existing pole comprising: a plate member having a top and a bottom surface, said plate having a plurality of reinforcing ribs extending radially outwardly from a central hub and having radially elongated apertures between said ribs receiving threaded fasteners therethrough for fastening said bracket to one of said pole top extension and existing pole; a rigidly attached center shaft extending perpendicularly outwardly from said top and bottom surfaces of said plate at said hub to be received in a center bore provided in said pole top extension and said existing pole; said reinforcing ribs being radially machined to receive threaded strap fasteners therein in radial alignment within said ribs; and a plurality of metal straps each provided with a threaded strap fastener aperture to secure said straps to the periphery of said plate and a plurality of strap securing apertures spaced longitudinally therealong to receive strap securing means for attaching said straps longitudinally to said existing and said extension poles.

15. A bracket for connecting a top extension pole member to an existing pole member said pole members each being provided with an axial center bore comprising: a pair of plate members each having a top and a bottom surface, a central hub and apertures for receiving fastening means therethrough for securing one of said pair of plates to each of said pole members; a rigidly attached center shaft extending perpendicularly outwardly from the bottom surfaces of each of said pair of plates at said hub, each to be received within the corresponding center bore of a pole member; a plurality of plate straps, each provided with a pair of plate strap fastener apertures to secure each of said plate straps to each of said pair of plates around the periphery thereof for securing said pair of plates together having their top surfaces in contact with each other.

* * * * *